US006004149A

United States Patent [19]

Ishikawa et al.

[11] Patent Number: 6,004,149

[45] Date of Patent: Dec. 21, 1999

[54] CLOCK SPRING

[75] Inventors: Satoshi Ishikawa; Hiraku Tanaka; Masakazu Umemura, all of Shizuoka, Japan

[73] Assignee: Yazaki Corporation, Tokyo, Japan

[21] Appl. No.: 09/129,897

[22] Filed: Aug. 6, 1998

[30] Foreign Application Priority Data

Aug. 7, 1997 [JP] Japan ..... 9-213431

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS 5,046,951 9/1991 Suzuki ..... 439/164

5,669,777 9/1997 Matsumoto et al. ..... 439/15

FOREIGN PATENT DOCUMENTS 7-193956 7/1995 Japan .

*Primary Examiner*—Gary Paumen

*Attorney, Agent, or Firm*—Finnegan, Henderson, Farabow, Garrett & Dunner, L.L.P.

[57] ABSTRACT

A clock spring comprises a cylindrical casing having a first connector, a cylindrical rotator disposed concentrically inside the casing, capable of rotating relative to the casing, and having a second connector, a carrier disposed rotatablly between the casing and the rotator, on which a rotatable cylindrical first roller is provided, a flexible cable in which one end thereof is connected to the second connector, is wound around an outer face of the rotator in a first direction, is reversed the winding direction into a second direction opposite to the first direction for being wound on an inner face of the outer casing in the second direction, and the other end thereof is connected to the first connector, a rotatable cylindrical second roller provided on the carrier next to the first roller, and a pillar-shaped first blocking member provided on that portion where between an outer face of the second roller and the inner face of the outer casing for preventing the flexible cable from invading the portion, the first blocking member positioned further than the nearest point on the outer face of the second roller with respect to the first roller.

4 Claims, 2 Drawing Sheets

CLOCK SPRING

BACKGROUND OF THE INVENTION

1. Technical Field of the Invention

The present invention relates to a clock spring (which is called also "a cable reel" or "rotary connector") utilized for connecting members rotating relatively with each other by means of a cable, and more particularly to the structure of a clock spring in which a flexible flat cable (hereinafter referred to merely as "an FFC", when applicable) is prevented from being folded.

2. Description of the Related Art

FIG. 3 shows a conventional clock spring of reverse type. The clock spring 1 comprises a cylindrical outer casing 2, and a cylindrical inside rotator 3. Between the outer casing 2 and the inside rotor 3, a carrier 5 is movably provided, and an FFC 4 is accommodated. The FFC 4 is wound on the rotator 3. One end of the FFC 4 is led out through an outlet 3*a*, and then reversed by the reverse portion 5*a* of the carrier 5, while the other end is connected to the connector (not shown) of the outer casing 2.

When the rotator 3 is turned clockwise, the FFC 4 is rewound, so that it is wound on the inner cylindrical surface of the outer casing 2 while leaving from the reverse section 5*a*.

FIG. 4 shows another conventional structure in which idler rollers 7 are provided on a carrier 5. In the structure, a FFC 4 is reversed by a reverse roller 7*a* of the idler rollers 7.

In the clock spring shown in FIG. 3, when the FFC 4 is rewound and a reversed portion 4*a* thereof is left from the reverse portion 5*a* of the carrier 5 as indicated by a chain line, the reversed portion 4*a* is brought into slide contact with the surface 5*b* of the carrier 5 which is opposite to the reverse portion 5*a*, thus providing a slide friction. This slide friction makes it rather difficult for the FFC 4 to be fed out. If the rotor 3 is further turned under this condition, since the FFC 4 is not smoothly fed out, the FFC 4 is folded near the outlet 3*a*, which makes the circuit of the FFC 4 open.

In the clock spring having the reverse roller 7*a* as shown in FIG. 4, the aforementioned slide friction can be reduced at the time of operation of ordinary rewinding the FEC 4. However, in the case of the FFC 4 which has been wound tight (the counterclockwise turn of the rotator 3) is abruptly rewound (the clockwise turn of the rotator 3), the reversed portion 4*a* of the FFC 4 enters while being deformed outside of the reverse roller 7*a* as indicated by a chain line, so that it is rather difficult for the FFC 4 to be fed out, and accordingly the FFC 4 is liable to be folded near the outlet 3*a*.

As is apparent from the above description, the conventional clock spring suffers from problems that it may be damaged by the folding of the FFC 4, and is low in reliability and in durability.

SUMMARY OF THE INVENTION

In view of the foregoing, an object of the present invention is to provide a clock spring which is free from the folding of the FFC, and the damage of the FFC attributing to the folding of the FFC, and is high in reliability and in durability.

To achieve the above object, there is provided a clock spring which comprises: a cylindrical casing having a first connector; a cylindrical rotator disposed concentrically inside the casing, capable of rotating relative to the casing, and having a second connector; a carrier disposed rotatablly between the casing and the rotator, on which a rotatable cylindrical first roller is provided; a flexible cable in which one end thereof is connected to the second connector, is wound around an outer face of the rotator in a first direction, is reversed the winding direction into a second direction opposite to the first direction for being wound on an inner face of the outer casing in the second direction, and the other end thereof is connected to the first connector; a rotatable cylindrical second roller provided on the carrier next to the first roller; and a pillar-shaped first blocking member provided on that portion where between an outer face of the second roller and the inner face of the outer casing for preventing the flexible cable from invading the portion, the first blocking member positioned further than the nearest point on the outer face of the second roller with respect to the first roller.

In the clock spring, at the time of ordinary rewinding operation of the flexible cable, the reversed portion thereof left from the first roller is brought into contact with only the second roller, and is not brought into contact with the first blocking member which is located further than the nearest point on the outer face of the second roller with respect to the first roller, and therefore the flexible cable slide friction will not be increased. On the other hand, in the operation of abruptly rewinding the flexible cable, the reversed portion thereof left from the first roller is deformed to contact the second roller and the first blocking member at the same time. In this case, the first blocking member prevents further invasion of the deformed portion of the reversed portion, thereby to prevent the increase in slide friction of the flexible cable. Hence, in both of the aforementioned operations, the flexible cable is smoothly slid, whereby the flexible cable is prevented from being folded or damaged due to folding thereof. Therefore, the clock spring of the present invention is high in reliability and in durability.

To obtain the same effect, the clock spring may further includes a second blocking member on that portion where between an outer face of the second roller and the outer face of the rotator for preventing the flexible cable from invading the portion, the second blocking member positioned further than the nearest point on the outer face of the second roller with respect to the first roller.

Further, in the clock spring, a surface of the first blocking member facing with the first roller has a recess-curved face.

Therefore, the deformed portion of the reversed portion of the flexible cable which is formed when the flexible cable is abruptly rewound abuts against the recess-curved surface, and accordingly the flexible cable is slid with a low slide resistance.

To obtain the same effect, a surface of the second blocking member facing with the first roller may have a recess-curved face.

DETAILED DESCRIPTION OF PREFERRED EMBODIMENT

Figure 3:
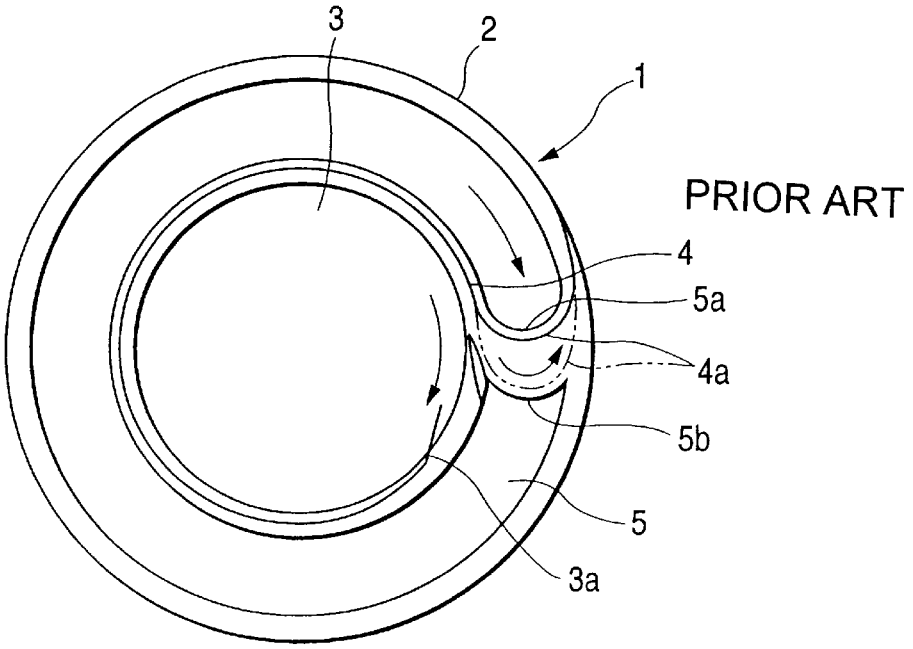
FIG. 3 is a plan view of a conventional clock spring showing a state that a cover of the clock spring is removed.
Figure 4:
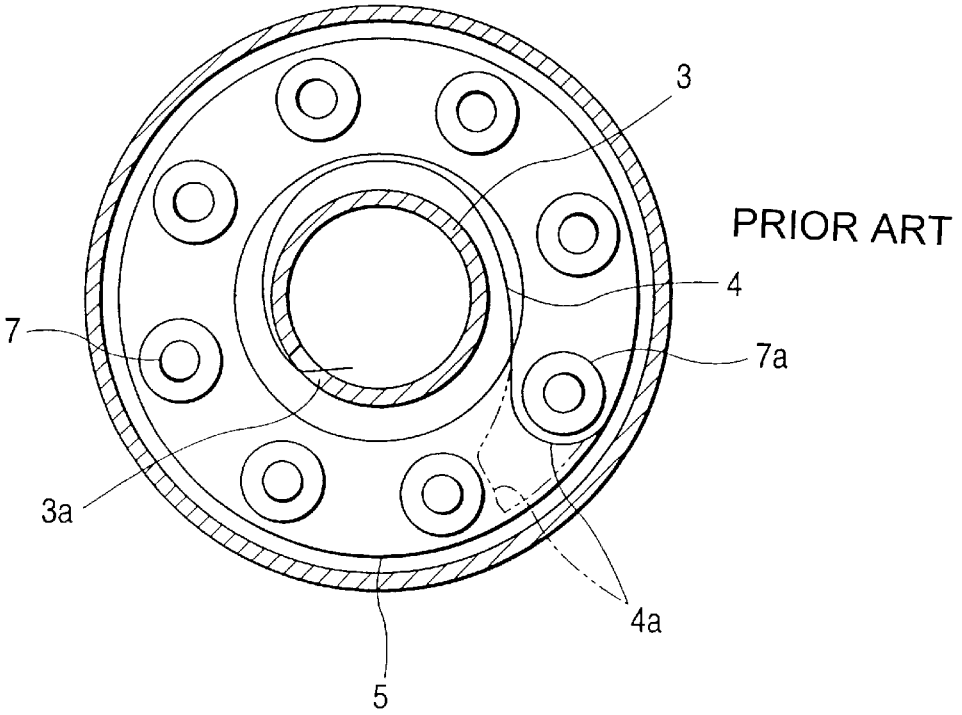
FIG. 4 is a plan view of another conventional clock spring showing a state that a cover of the clock spring is removed.

One preferred embodiment of the present invention will be described below in detail with reference to the accompanying drawings. Parts corresponding functionally to those already described with reference to FIGS. 3 and 4 are denoted by the same reference numerals and characters.

Figure 1:
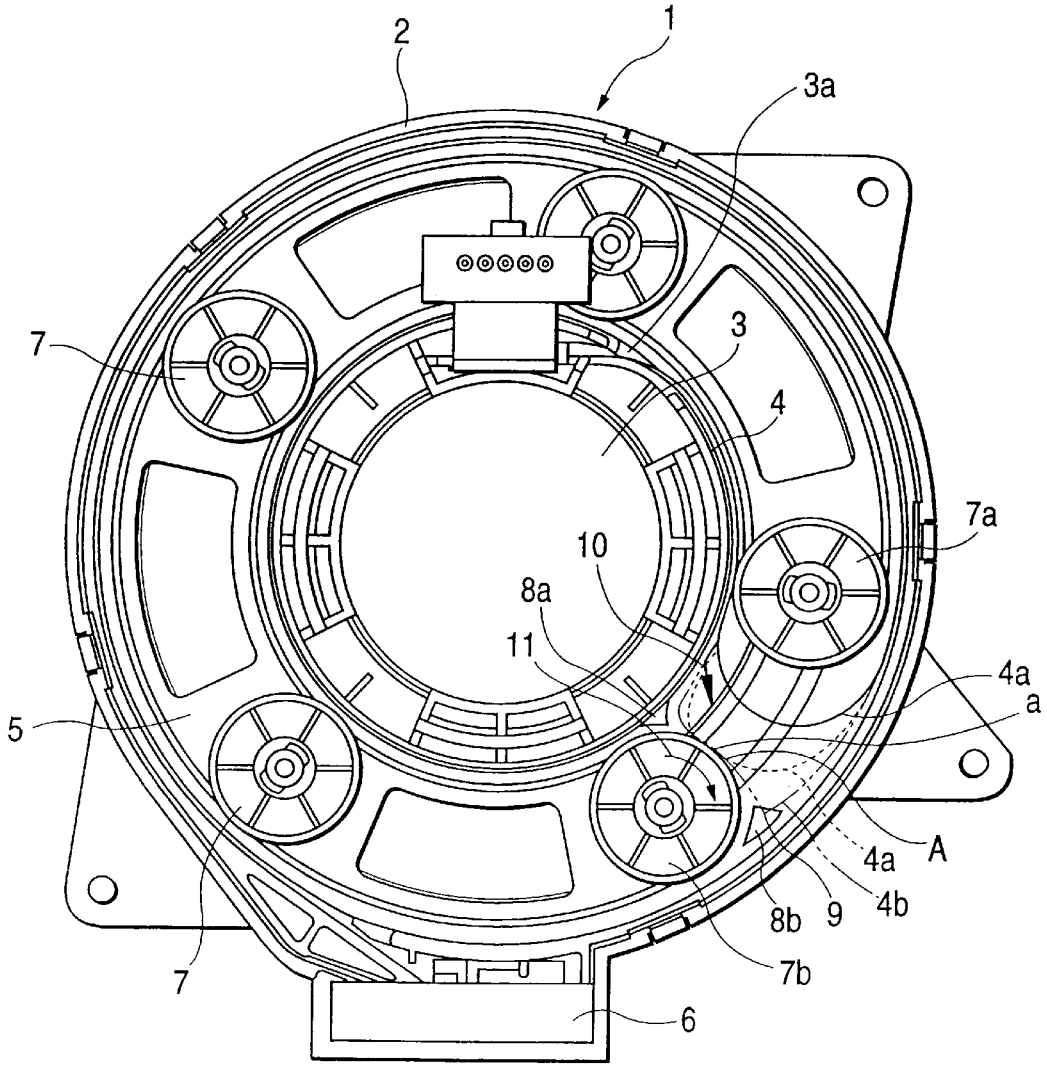
FIG. 1 is a plan view of one embodiment according to the present invention showing a state that a cover of the clock spring is removed.

In FIG. 1, a clock spring 1 comprises a cylindrical outer case 2, and an inside rotator 3. A carrier 5 is movably provided between the outer casing 2 and the rotator 3. The carrier 5 has a plurality of idler rollers 7. One of the idler rollers 7 is employed as a reverse roller 7*a*, and one another is employed as a guide roller 7*b*. One end portion of an FFC 4 is led out through an outlet 3*a* formed in the rotator 3, and is then reversed by the reverse roller 7*a*, and the other end portion of the FFC 4 is connected to a connector 6 mounted on the outer casing 2.

Figure 2:
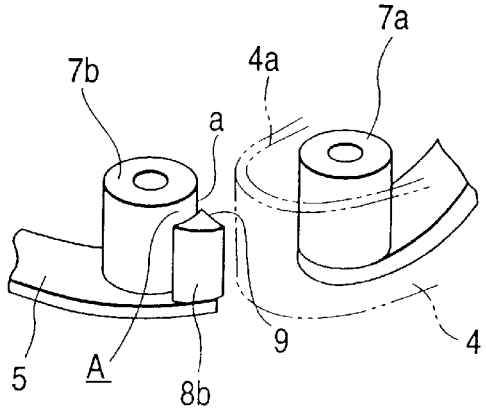
FIG. 2 is a perspective view showing essential parts of the clock spring shown in FIG. 1.

As shown in FIG. 2, in the vicinity of the guide roller 7*b*, a pair of pillar-shaped blocking members 8*a* and 8*b* are provided on the carrier 5 in such a manner that they are located in both sides of a front outer wall portion A of the guide roller 7*b* facing the reverse roller 7*a*. Specifically, the blocking members 8*a* and 8*b* are located further away from the reverse roller 7*a* than frontmost part a of the front outer wall portion A. The front surfaces of the pair of the blocking members 8*a* and 8*b* are recess-curved surfaces 9 which are so shaped as to correspond to the deformation of the reversed portion 4*a* of the FFC 4.

In this structure, during the normal rewinding operation in which the rotator 3 is turned clockwise, as indicated by a dotted line in FIG. 1, the reverse portion 4*a* left from the reverse roller 7*a* is brought into contact with only the frontmost part a in the front outer wall portion A of the guide roller 7*b* and it is not brought into contact with the blocking members 8*a* and 8*a* which are located behind the frontmost part a. Hence, the slide friction of the FFC 4 is not increased.

When the FFC 4 is abruptly rewound, the reversed portion 4*a* left from the reverse roller 7*a* is deformed, thus being brought into contact with the guide roller 7*b* and at least one of the blocking members 8*a* and 8*b* at the same time. In this case, the blocking members 8*a* and 8*b* prevent the further invasion of the deformed portion 4*b* of the reverse portion 4*a* thereby to prevent an increase in the slide friction of the FFC 4. In this case, the blocking member 8*a* prevents the deformed portion 4*b* of the reversed portion 4*a* from entering the gap between the outer wall of the rotator 3 and the outer wall of the guide roller 7*b*, while the blocking member 8*b* prevents the deformed portion 4*b* of the reversed portion 4*a* from entering the gap between the inner wall of the outer casing 2 and the outer wall of the guide roller 7*b*. Furthermore, since the deformed portion 4*b* of the reverse portion 4*a* abuts against the recess-curved surfaces 9 of the blocking members 8*a* and 8*b* formed in aforementioned shape, the FFC slides with a low slide friction.

According to this embodiment, both in the ordinary rewinding operation of the FFC 4 and in the abrupt rewinding operation of the same, the FFC slides smoothly without increasing the sliding resistance. Hence, the folding of the FFC 4 formed near the outlet 3*a* of the rotator 3, and the breakage of the FFC 4 attributing to the folding can be prevented. This feature can improve the reliability and durability of the clock spring.

In the abrupt winding operation of the FFC, a force is applied to the reversed portion 4*a* of the FFC in the direction of the arrow 10, so that the guide roller 7*b* is turned in the direction of the arrow 11, whereby the reversed portion 4*a* is liable to be deformed in the direction of the arrow 11. Although a pair of guide members 8*a* and 8*b* are provided in the embodiment, the same object can be achieved by the provision of only one guide member 8*b* which is in the side of the outer casing 2.

As has been described heretofore, according to the present invention, at the time of ordinary rewinding operation of FFC, the reversed portion of the FFC left from the reverse roller is brought into contact with only the guide roller, and is not brought into contact with the blocking members which are located behind the frontmost part of the front outer wall portion of the guide roller, and therefore the FFC slide friction will not be increased. On the other hand, in the operation of abruptly rewinding the FFC, the reversed portion left from the reverse roller is deformed to contact the guide roller and the blocking members at the same time. In this case, the blocking members prevent further invasion of the deformed portion of the reversed portion, thereby to prevent the increase in slide friction of the FFC. Hence, in both of the aforementioned operations, the FFC is smoothly slid, whereby the FFC is prevented from being folded or damaged due to folding thereof. Therefore, the clock spring of the present invention is high in reliability and in durability.

In the present invention of claim 2, the pillar-shaped blocking members have the downwardly curved surfaces which are confronted with the reverse roller.

Furthermore, the deformed portion of the reversed portion of the FFC which is formed when the FFC is abruptly rewound abuts against the recess-curved surfaces, and accordingly the FFC is slid with a low slide friction. It is therefore the FFC is smoothly slid even when the FFC is abruptly rewound.

What is claimed is:

1. A clock spring comprising:

a cylindrical casing having a first connector;

a cylindrical rotator disposed concentrically inside the casing, capable of rotating relative to the casing, and having a second connector;

a carrier disposed rotatablly between the casing and the rotator, on which a rotatable cylindrical first roller is provided;

a flexible cable in which one end thereof is connected to the second connector, is wound around an outer face of the rotator in a first direction, is reversed the winding direction into a second direction opposite to the first direction for being wound on an inner face of the outer casing in the second direction, and the other end thereof is connected to the first connector;

a rotatable cylindrical second roller provided on the carrier next to the first roller; and a pillar-shaped first blocking member provided on a portion between an outer face of the second roller and the inner face of the outer casing for preventing the flexible cable from invading the portion, the first blocking member positioned further than the nearest point on the outer face of the second roller with respect to the first roller.

2. The clock spring as set forth in claim 1, wherein a surface of the first blocking member facing with the first roller has a recess-curved face.

3. The clock spring as set forth in claim 1 further comprising:

a second blocking member on a second portion between an outer face of the second roller and the outer face of the rotator for preventing the flexible cable from invading the second portion, the second blocking member positioned further than the nearest point on the outer face of the second roller with respect to the first roller.

4. The clock spring as set forth in claim 2, wherein a surface of the second blocking member facing with the first roller has a recess-curved face.

* * * * *